US008958734B2

(12) United States Patent
Tanaka

(10) Patent No.: US 8,958,734 B2
(45) Date of Patent: Feb. 17, 2015

(54) FIXING DEVICE AND IMAGE FORMING APPARATUS

(75) Inventor: Atsushi Tanaka, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 178 days.

(21) Appl. No.: 13/617,000

(22) Filed: Sep. 14, 2012

(65) Prior Publication Data

US 2013/0129396 A1 May 23, 2013

(30) Foreign Application Priority Data

Nov. 22, 2011 (JP) ..... 2011-255458

(51) Int. Cl.
*G03G 15/20* (2006.01)

(52) U.S. Cl.
CPC ..... *G03G 15/2064* (2013.01); *G03G 15/2053* (2013.01); *G03G 2215/2029* (2013.01)
USPC ..... 399/331

(58) Field of Classification Search
CPC . G03G 15/20; G03G 15/206; G03G 15/2003; G03G 15/2092; G03G 15/2096
See application file for complete search history.

(56) References Cited

U.S. PATENT DOCUMENTS

| | | | | |
|---|---|---|---|---|
| 5,722,026 | A * | 2/1998 | Goto et al. | 399/333 |
| 2003/0099488 | A1 * | 5/2003 | Tanaka et al. | 399/176 |
| 2007/0166085 | A1 | 7/2007 | Shinshi | |
| 2009/0003900 | A1 | 1/2009 | Shimizu et al. | |

FOREIGN PATENT DOCUMENTS

| | | |
|---|---|---|
| JP | 64-040869 | 2/1989 |
| JP | 9-218601 | 8/1997 |
| JP | 2005-208321 | 8/2005 |
| JP | 2007-206265 | 8/2007 |
| JP | 2007-233084 | 9/2007 |
| JP | 2008-115014 | 5/2008 |
| JP | 2011-002590 | 1/2011 |

* cited by examiner

*Primary Examiner* — Clayton E LaBalle
*Assistant Examiner* — Victor Verbitsky
(74) *Attorney, Agent, or Firm* — Nixon & Vanderhye P.C.

(57) ABSTRACT

There are provided a fixing device having excellent fixation properties when a toner image is fixed onto a member to be subjected to fixation, and an image forming apparatus including the fixing device. A fixing device includes a fixing belt, a fixing roller and a heating roller between which the fixing belt is wound under tension, and a pressure roller which is in pressure-contact with the fixing roller through the fixing belt. An elastic layer as a surface layer of the fixing roller has, when being brought into pressure-contact with the pressure roller through the fixing belt, a pressing rate of 40% or more, and an Asker C hardness of 20 degrees or more and less than 30 degrees.

4 Claims, 3 Drawing Sheets

FIXING DEVICE AND IMAGE FORMING APPARATUS

CROSS-REFERENCE TO RELATED APPLICATION

This application claims priority to Japanese Patent Application No. 2011-255458, which was filed on Nov. 22, 2011, the contents of which are incorporated herein by reference in its entirety.

BACKGROUND OF THE TECHNOLOGY

1. Field of the Technology

The present technology relates to a fixing device for fixing a toner image and an image forming apparatus including the fixing device.

2. Description of the Related Art

An electrophotographic image forming apparatus for forming an image based on electrophotography (hereinafter simply referred to as an "image forming apparatus") is able to easily form an image having favorable image quality. The image forming apparatus is widely used as a copier, a printer, a facsimile apparatus, a multi-functional peripheral, and the like.

Examples of a fixing device provided in such an image forming apparatus include a fixing device of heat roller fixing type.

The fixing device of heat roller fixing type includes a fixing roller and a pressure roller. The fixing roller and the pressure roller are a pair of rollers in pressure-contact with each other. Inside at least one of the fixing roller and the pressuring roller, a heat source such as a halogen heater is included as a heating section.

In the fixing device, after the pair of rollers is heated with the heat source to a predetermined temperature required for fixing (hereinafter referred to as a "fixing temperature"), recording paper such as paper on which an unfixed toner image is formed is supplied to a fixing nip section which is a pressure-contact part of the fixing roller and the pressure roller. The unfixed toner image passing through the fixing nip section is fixed onto the recording paper by heat transferred from at least either one of the fixing roller and the pressure roller as well as pressure by the fixing roller and the pressure roller. The temperature of a part of the fixing nip section through which the recording paper has passed (hereinafter referred to as a "paper passing section") is decreased but heated to the fixing temperature by the heat source.

When a fixing roller on which surface an elastic layer is provided (hereinafter referred to as an "elastic roller") is used as the fixing roller, at the fixing nip section, the elastic layer on the surface of the elastic roller is elastically deformed corresponding to unevenness of an unfixed toner image. The elastic roller contacts with the unfixed toner image so as to cover and wrap the unfixed toner image, thus making fixation properties favorable for an unfixed color toner image with a large amount of a toner compared to a monochromatic image. Moreover, the elastic roller improves release properties of a color toner which is easier to offset compared to the monochromatic image by a strain release effect of the elastic layer on the surface of the elastic roller.

A nip shape as a shape between the fixing roller and the pressure roller on the fixing nip section becomes a protruded shape on the fixing roller side (an inverse nip shape), thus improving peeling properties between the fixing roller and recording paper. As a peeling section for peeling recording paper from the fixing roller, for example, self-stripping is realized which is capable of peeling recording paper from the fixing roller without using a peeling claw so as to resolve an image defect caused by the peeling section. In a fixing device included in an image forming apparatus capable of performing full-color printing, for example, silicone rubber or the like is used as an elastic layer of the elastic roller.

In the fixing device included in the image forming apparatus capable of performing full-color printing, it is necessary to widen a nip width as a width in a conveyance direction of recording paper of the fixing nip section to cope with higher speed. As a way of widening the nip width, there are two methods. That is, one is to thicken the elastic layer of the elastic roller, whereas the other is to enlarge a diameter of the elastic layer. However, since the elastic layer of the elastic roller has very low heat conductivity, when the elastic layer of the elastic roller having the heating section inside the elastic roller is thickened, in a case where processing speed is increased, it becomes impossible for a temperature of the fixing roller to follow the fixing temperature. Moreover, when a diameter of the elastic roller is enlarged, warm-up time is extended and power consumption at the heating section is increased.

In order to solve such problems, Japanese Unexamined Patent Publication JP-A 9-218601 (1997) discloses a belt fixing type fixing device including a fixing roller, a pressure roller, a heating roller and a fixing belt. In the fixing device disclosed in JP-A 9-218601, a fixing belt is suspended between a fixing roller and a heating roller having inside of which a heater for heating, and the fixing roller is brought into pressure-contact with the pressure roller through the fixing belt.

In such a fixing device, warm-up time is short since the fixing belt having a small heat capacity is heated, and it is not necessary to incorporate a heat source such as a halogen lamp in the fixing roller, thus a thick elastic layer with low hardness made of sponge rubber or the like is able to be provided, so that it is possible to secure a wide nip width.

However, in the conventional belt fixing type fixing device as disclosed in JP-A 9-218601, there is room for improvement in fixation properties when an unfixed color toner image requiring a large amount of a toner is fixed to recording paper having a surface shape with significant unevenness.

SUMMARY OF THE TECHNOLOGY

An object of the technology is therefore to provide a fixing device having excellent fixation properties when a toner image is fixed onto recording paper and an image forming apparatus including the fixing device.

The technology provides a fixing device including:

an endless fixing belt for contacting with a toner image on a member to be subjected to fixation and fixing the toner image onto the member to be subjected to fixation;

a heating roller for contacting with an inner circumferential surface of the endless fixing belt and heating the endless fixing belt;

a fixing roller including a base member and an elastic layer disposed on a surface of the base member, the endless fixing belt being wound under tension between the fixing roller and the heating roller, the fixing roller contacting with the toner image on the member to be subjected to fixation through the endless fixing belt; and a pressure roller for coming into pressure-contact with the fixing roller through the endless fixing belt, the elastic layer having a pressing rate of 40% or more, the pressing rate being a ratio of a deformation amount when being brought into pressure-contact with the pressure roller through the endless fixing belt with respect to a thickness size when not being brought into pressure-contact, and having an Asker C hardness of 20 degrees or more and less than 30 degrees.

The fixing device includes the endless fixing belt, the heating roller and the fixing roller between which the endless fixing belt is wound under tension, and the pressure roller. The endless fixing belt contacts with a toner image on the member to be subjected to fixation and fixes the toner image onto the member to be subjected to fixation. The heating roller contacts with the inner circumferential surface of the endless fixing belt and heats the endless fixing belt. The fixing roller includes a base member and the elastic layer which is formed on the surface of the base member and contacts with the toner image on the member to be subjected to fixation through the endless fixing belt. The pressure roller comes into pressure-contact with the fixing roller through the endless fixing belt. In the fixing device configured in this manner, when the member to be subjected to fixation passes through the fixing nip section which is a part at which the fixing roller and the pressure roller are in contact with each other through the endless fixing belt, the toner image contacts with the endless fixing belt heated by the heating roller, so that the toner image is fixed onto the member to be subjected to fixation.

Moreover, the elastic layer of the fixing roller has the pressing rate of 40% or more when being brought into pressure-contact with the pressure roller through the endless fixing belt, and has the Asker C hardness of 20 degrees or more and less than 30 degrees.

The elastic layer of the fixing roller has the pressing rate of 40% or more, thereby making it possible to improve followability of the elastic layer for slight unevenness on the surface of the member to be subjected to fixation, thus making it possible to uniformly heat the toner image on the member to be subjected to fixation in contact with the endless fixing belt. Further, the elastic layer of the fixing roller has the Asker C hardness of 20 degrees or more and less than 30 degrees, and it is thereby possible to widen the nip width as the width in a conveyance direction of the member to be subjected to fixation in the fixing nip section, thus making it possible to extend passing time of the member to be subjected to fixation through the fixing nip section and efficiently heat the toner image on the member to be subjected to fixation in contact with the endless fixing belt.

Accordingly, the fixing device has excellent fixation properties when fixing the toner image onto the member to be subjected to fixation.

Additionally, it is preferable in the fixing device that the elastic layer has a repulsive rate of 65% or more.

Moreover, it is preferable in the fixing device that the elastic layer has a pressing rate of 45% and an Asker C hardness of 20 degrees.

The elastic layer of the fixing roller has a repulsive rate of 65% or more. Here, the repulsive rate is represented by: Repulsive rate=(H2/H1)×100, where a weight with an outer diameter of 11 mm and weight of 7 g suspended by a 50 cm-long thread is, in a resting state, at a lowest point, contacting with the fixing roller so that the center of gravity of the weight is disposed on a horizontal plane including a central axis of the fixing roller, a height in which the weight is pulled up by a height of H1=10 cm from the lowest point, and the weight is rebounded from the lowest point when the weight is released gently to cause the weight to collide with the fixing roller is H2.

The elastic layer has the repulsive rate of 65% or more, and it is thereby possible to increase the strain release effect of the elastic layer, thus making it possible to improve the peeling properties of the member to be subjected to fixation passing through the fixing nip section with respect to the endless fixing belt. Specifically, in the elastic layer which is compressed at the fixing nip section to cause strain, the strain is released at an exit of the fixing nip section (on a downstream side in the conveyance direction of the member to be subjected to fixation), and a gap is thus generated between the elastic layer and the member to be subjected to fixation through the endless fixing belt at the exit of the fixing nip section. As a result, it is possible to improve peeling properties of the member to be subjected to fixation passing through the fixing nip section with respect to the endless fixing belt.

Moreover, the technology provides an image forming apparatus including the fixing device mentioned above.

The image forming apparatus includes the fixing device of the technology having excellent fixation properties when fixing the toner image onto the member to be subjected to fixation. Therefore, the image forming apparatus is able to form an image having favorable image quality.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
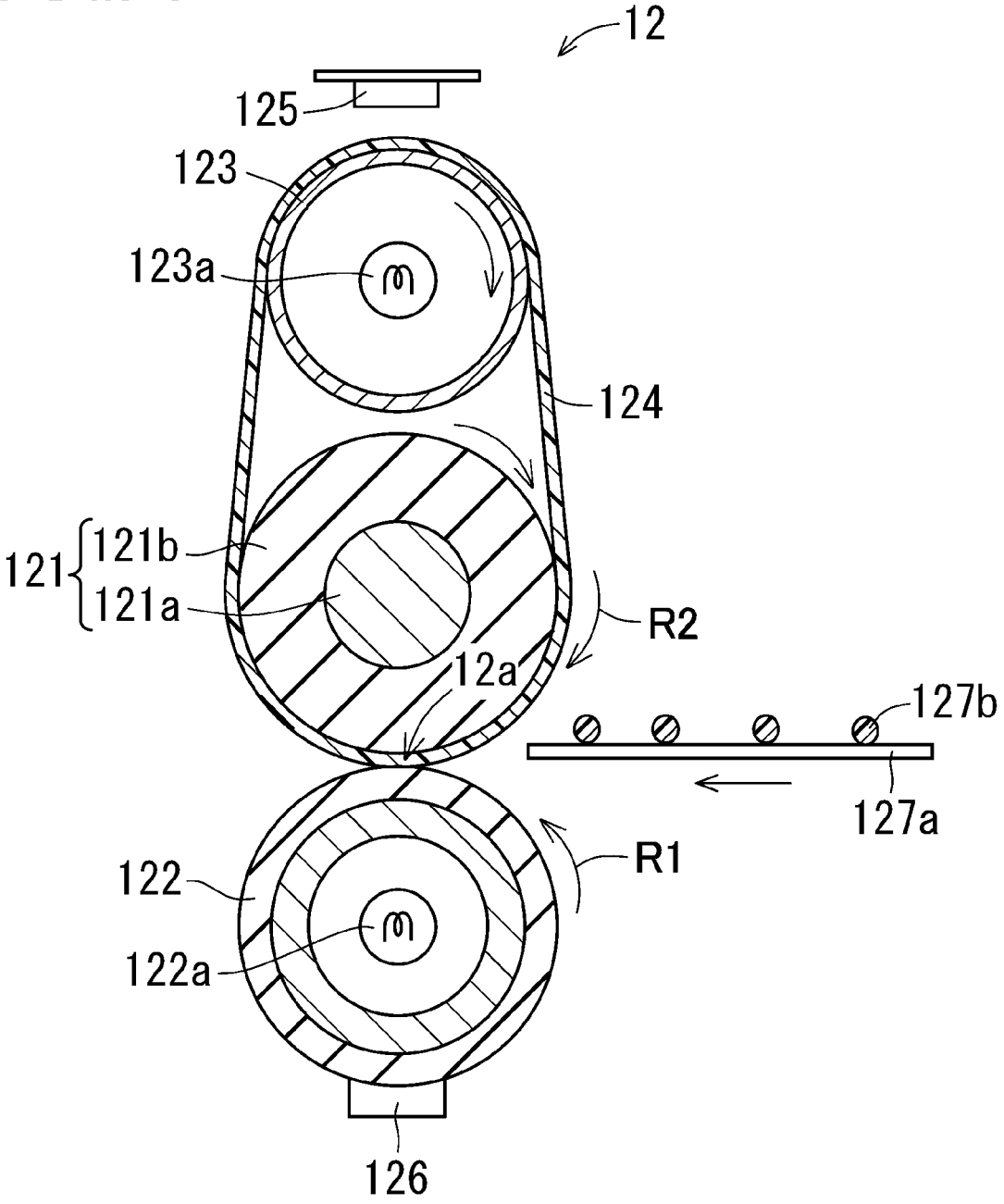
FIG. 1 is a cross-sectional view for schematically showing a configuration of a fixing device according to an embodiment.

FIG. 1 is a cross-sectional view for schematically showing a configuration of a fixing device 12 according to an embodiment. The fixing device 12 includes a fixing roller 121, a pressure roller 122, an endless fixing belt 124, a heating roller 123 for heating the fixing belt 124, the fixing belt 124 being wound under tension between the fixing roller 121 and the heating roller 123, a heater lamp for the pressure roller 122*a* as a heat source for heating the pressure roller 122, a heater lamp for the heating roller 123*a* as a heat source for heating the heating roller 123, a thermistor for the fixing belt 125 as a temperature sensor constituting a temperature detection section for detecting a surface temperature of the fixing belt 124, and a thermistor for the pressure roller 126 for detecting a surface temperature of the pressure roller 122.

In the fixing device 12, the fixing belt 124 is wound under tension between the fixing roller 121 and the heating roller 123, and the pressure roller 122 is disposed so as to face the fixing roller 121 through the fixing belt 124. Then, the fixing roller 121, the pressure roller 122, and the heating roller 123 are disposed so that the respective axes are parallel to each other.

The fixing device 12 is a belt fixing type fixing device in which the heating roller 123 contacts with the fixing belt 124 to heat the fixing belt 124, and when recording paper 127*a* as a member to be subjected to fixation passes at predetermined fixation speed and duplication speed through a fixing nip section 12*a* that is formed between the fixing belt 124 and the pressure roller 122, an unfixed toner image 127*b* borne on the recording paper 127*a* is fixed onto the recording paper 127*a* under application of heat and pressure. Such a fixing device 12 as the belt fixing type device is configured to heat the fixing belt 124 having a small heat capacity by the heating roller 123, warm-up time is thus short and increase of power consumption is suppressed, so that it is possible to achieve energy saving.

Note that, the unfixed toner image 127*b* is formed by, for example, a developer (toner) such as a non-magnetic one-component developer (non-magnetic toner), a non-magnetic two-component developer (non-magnetic toner and carrier), and a magnetic developer (magnetic toner). In addition, the fixation speed is so-called processing speed, and the duplication speed is the number of copy sheets per minute. Moreover, when the recording paper 127*a* passes through the fixing nip section 12*a*, the fixing belt 124 comes into contact with a toner-image bearing surface of the recording paper 127*a*.

The fixing roller 121 has a substantially cylindrical shape, and has a two-layered structure in which a core bar 121*a* as a base member and an elastic layer 121*b* are disposed from a central axis of the substantially cylindrical shape toward an outer periphery thereof. For the core bar 121*a*, a metal such as iron, stainless steel, aluminum, or copper, or alloy thereof is used. For the elastic layer 121*b*, a rubber material having heat resistance such as silicone rubber and fluorine rubber is appropriate. In the present embodiment, the fixing roller 121 has a diameter of 50 mm. Stainless steel with a diameter of 20 mm is used for the core bar 121*a*, and silicone sponge rubber with a thickness of 15 mm is used for the elastic layer 121*b*.

The fixing roller 121 is disposed so as to be rotatable around the central axis of the substantially cylindrical center shape, and rotates by being driven by rotation of the pressure roller 122. The fixing roller 121 is brought into pressure-contact with the pressure roller 122 through the fixing belt 124, thereby forming the fixing nip section 12*a* which is a part at which the fixing roller 121 and the pressure roller 122 come into contact with each other through the fixing belt 124.

The pressure roller 122 has a substantially cylindrical shape and has a three-layered structure in which a core bar, an elastic layer and a release layer are disposed from a central axis of the substantially cylindrical shape toward an outer periphery thereof. For the core bar, a metal such as iron, stainless steel, aluminum, or copper, or an alloy thereof is used. For the elastic layer, a rubber material having heat resistance such as silicone rubber or fluorine rubber is appropriate. For the release layer, a fluorine resin such as PFA (a copolymer of tetrafluoroethylene and perfluoroalkyl vinyl ether) or PTFE (polytetrafluoroethylene) is used. In the embodiment, the pressure roller 122 has a diameter of 50 mm. Iron (STKM) having a diameter of 48 mm and a thickness of 1 mm is used for the core bar. Solid silicone rubber having a thickness of 1 mm is used for the elastic layer. A PFA tube having a thickness of 30 μm is used for the release layer.

The heater lamp for the pressure roller 122*a* is disposed inside the pressure roller 122 and heats the pressure roller 122. A control circuit (not shown) supplies power (electrifies) from a power supply circuit (not shown) to the heater lamp for the pressure roller 122*a*, whereby the heater lamp for the pressure roller 122*a* emits light, and infrared rays are radiated from the heater lamp for the pressure roller 122*a*. In the pressure roller 122, an inner circumferential surface of the pressure roller 122 absorbs the infrared rays radiated from the heater lamp for the pressure roller 122*a*, so that the entire pressure roller 122*a* is heated. In the embodiment, the heater lamp for the pressure roller 122*a* with rated power of 1200 W is used.

The pressure roller 122 is disposed so as to be rotatable around the central axis of the substantially cylindrical shape. The pressure roller 122 is a roller-like member which is rotationally driven by a driving motor which is a driving section (not shown). The fixing roller 121 is brought into pressure-contact with the pressure roller 122 through the fixing belt 124, thereby forming the fixing nip section 12*a*, and at the same time rotates accordingly, thereby conveying the fixing belt 124. The fixing roller 121 rotates in an opposite direction to the pressure roller 122.

The fixing roller 121 and the pressure roller 122 are brought into pressure-contact with each other with a predetermined load, for example, 900 N. When the fixing roller 121 and the pressure roller 122 are brought into pressure-contact with each other, the fixing nip section 12*a* is formed. In the embodiment, a width of the fixing nip section 12*a* in the conveyance direction of recording paper (hereinafter referred to as a "nip width") is 14 mm. To the fixing nip section 12*a*, the recording paper 127*a* with the unfixed toner image 127*b* borne thereon is fed. The recording paper 127*a* passes through the fixing nip section 12*a*, thereby fixing the toner image 127*b* onto the recording paper 127*a*. When the recording paper 127*a* passes through the fixing nip section 12*a*, the fixing belt 124 comes into contact with the toner-image bearing surface of the recording paper 127*a*, and the pressure roller 122 comes into contact with the surface of the recording paper 127*a* opposite to the toner-image bearing surface.

The heating roller 123 has a substantially cylindrical shape and has a three-layered structure in which an infrared ray absorbing layer, a core bar and a protective layer are disposed from a central axis of the substantially cylindrical shape toward an outer periphery thereof. A heat-resistant carbon-containing paint is applied to the inside of the core bar and then fired, thereby forming the infrared ray absorbing layer. For the core bar, for example, a metal such as iron, stainless steel, aluminum, or copper, or an alloy thereof is used. For the protective layer, a fluorine resin such as PFA or PTFE is appropriate. The protective layer prevents the fixing belt 124 and the heating roller 123 from being abraded due to contact with the fixing belt 124 and the heating roller 123.

In the embodiment, the heating roller 123 has a diameter of 35 mm, a carbon black coating having a thickness of 10 μm is used as the infrared ray absorbing layer, and a hollow aluminum material having a diameter of 35 mm and a thickness of 0.7 mm is used for the core bar. For the protective layer, a PTFE coat having a thickness of 20 μm is used.

The heater lamp for the heating roller 123*a* for heating the heating roller 123 is disposed inside the heating roller 123. A control circuit (not shown) supplies power (electrifies) from a power supply circuit (not shown) to the heater lamp for the heating roller 123*a*, whereby the heater lamp for the heating roller 123*a* emits light, and infrared rays are radiated from the heater lamp for the heating roller 123*a*. In the heating roller 123, the inner circumferential surface of the heating roller 123 absorbs the infrared rays radiated from the heater lamp for the heating roller 123*a*, so that the entire heating roller 123 is heated. In the embodiment, the heater lamp for the heating roller 123*a* with rated power of 1200 W is used. To the heating roller 123, a predetermined load, for example, 900 N is applied in a direction opposite to a direction in which the fixing roller 121 is disposed, in the case of being viewed from the heating roller 123. Tension is applied to the fixing belt 124, so that the heating roller 123 rotates with rotation of the fixing belt 124.

The fixing belt 124 has a diameter of 75 mm in a state of not being mounted. The fixing belt 124 is formed of a cylindrical hollow base member made of a heat-resistant resin such as polyimide, or a metal material such as stainless steel and nickel. On a surface of the base member, an elastic layer made of an elastomer material such as silicone rubber, for example, having excellent heat resistance and elasticity is formed. On a surface of the elastic layer, a release layer made of a synthetic resin material which is a fluorine resin such as PFA or PTFE, for example, having excellent heat resistance and releasing properties is formed. The fixing belt 124 is constituted by three layers of the base member, the elastic layer and the release layer. In the embodiment, polyimide having a thickness of 70 μm is used for the base member, silicone rubber having a thickness of 200 μm is used for the elastic layer, and a PFA tube having a thickness of 30 μm is used for the release layer.

The fixing belt 124 which is heated to a predetermined temperature by the heating roller 123, heats the recording paper 127*a* with an unfixed toner image 127*b* formed thereon, passing through the fixing nip section 12*a*. The fixing belt 124 is wound under tension between the heating roller 123 and the fixing roller 121. The fixing belt 124 is driven by rotation of the pressure roller 122 and rotates in a direction of an arrow R2. The pressure roller 122 rotates in a direction of an arrow R1 and the fixing belt 124 rotates in a direction of the arrow R2, whereby the recording paper 127*a* passes through the fixing nip section 12*a*.

Next description will be given in detail for the fixing roller 121 in the fixing device 12 in the embodiment. As mentioned above, the fixing roller 121 has a two-layered structure including the core bar 121*a* and the elastic layer 121*b* which is disposed on the surface of the core bar 121*a*. The pressing rate, hardness, and the repulsive rate of the elastic layer 121*a* are set based on the following experimental results.

<Experimental Condition>

[Configuration of Fixing Device]

Fixing roller 121: the core bar 121*a* is made of a cylindrical iron material with a diameter of 20 mm, the elastic layer 121*b* is made of silicone sponge rubber with a thickness of 15 mm, and an outer diameter is 50 mm.

Pressure roller 122: the core bar is made of a hollow cylindrical iron material with a thickness of 1 mm, the elastic layer is made of solid silicone rubber with a thickness of 1 mm, the release layer is made of a PFA tube with a thickness of 30 μm, and an outer diameter is 50 mm.

Heating roller 123: the core bar is made of a hollow cylindrical aluminum material with a thickness of 0.7 mm, the infrared ray absorbing layer is made of carbon black paint with a thickness of 10 μm, a protective layer is made of a PTFE coat with a thickness of 20 μm, the release layer is made of a PFA tube with a thickness of 20 μm, and an outer diameter is 30 mm.

Fixing belt 124: A polyimide layer as a base member has a thickness of 70 μm, a rubber layer as an elastic layer has a thickness of 200 μm, and a PFA tube as a surface layer which is a release layer has a thickness of 30 μm.

[Fixation Condition]

Processing speed, that is, fixation speed was set to 330 mm/s, and for recording paper, plain paper with a basis weight of 68 g was used. An image was formed by layering four colors of cyan (C), magenta (M), yellow (Y), and black (K), on a leading edge of the recording paper in the conveyance direction thereof in solid black with a toner amount of 1.0 mg/cm$^2$.

<Evaluation Method>

[Fixable Temperature Range]

As an upper limit of a fixable temperature, an offset start temperature was measured by visually confirming presence/absence of an offset on the recording paper. Then, as a lower limit of the fixable temperature, a lowest fixable temperature was measured. Difference between the offset start temperature and the lowest fixable temperature was regarded as a fixable temperature range. A wider fixable temperature range indicates that the more excellent fixation properties is provided.

[Self-Peeling Temperature Range]

As an index of peeling properties of the recording paper from the fixing belt 124, a self-peeling temperature range was measured. Specifically, the self-peeling temperature range was measured under a condition of not using the peeling section by determining whether the recording paper was able to be separated from a surface of the fixing belt 124 until the fixing roller 121 performed quarter rotation after the recording paper passed through the fixing nip section 12*a*. A wider self-peeling temperature range indicates that the more excellent peeling properties of the recording paper is provided.

Experiment A

Setting of Pressing Rate of Elastic Layer

By changing a pressure-contact load by the pressure roller 122 with respect to the fixing roller 121, a pressing rate of the elastic layer 121*b* of the fixing roller 121 was changed, so that relation among the pressing rate, the fixable temperature range and the self-peeling temperature range was evaluated. Note that, in the experiment A, an Asker C hardness of the elastic layer 121*b* was 20 to 30 degrees, and a repulsive rate described below was set to be 70%.

The pressing rate of the elastic layer 121*b* of the fixing roller 121 is represented by a ratio of a deformation amount when being brought into pressure-contact with the pressure roller 122 through the fixing belt 124 with respect to a thickness size when not being brought into pressure-contact. Specifically, where the thickness size of the elastic layer 121*b* when being brought into pressure-contact with the pressure roller 122 is "M", and the thickness size of the elastic layer 121*b* when not being brought into pressure-contact is "N", a pressing rate L is calculated based on the following formula (I).

$$\text{Pressing rate } L(\%)=\{(N-M)/N\}\times 100 \quad (1)$$

Evaluation results are shown in Table 1.

TABLE 1

| | Pressing rate (%) | | | | | | | | |
|---|---|---|---|---|---|---|---|---|---|
| | 15 | 25 | 30 | 35 | 40 | 45 | 50 | 55 | 60 |
| Fixable temperature range (deg) | 30 | 35 | 35 | 40 | 50 | 50 | 50 | 45 | 40 |
| Self-peeling temperature range (deg) | 10 | 30 | 35 | 35 | 50 | 50 | 50 | 50 | 45 |

As cleared from the results in Table 1, it is found out that with the pressing rate of 40% or more of the elastic layer 121*b* of the fixing roller 121, the fixable temperature range is wide. The reason is that with the pressing rate of 40% or more, it is possible to improve followability of the elastic layer 121*b* with respect to subtle unevenness on the surface of the recording paper, thus making it possible to uniformly heat a toner image on the recording paper in contact with the fixing belt 124. Additionally it has been found out that with the pressing rate of 40% or more of the elastic layer 121*b* of the fixing roller 121, it is possible to secure a wide self-peeling temperature range.

Note that, the pressing rate of the elastic layer 121*b* of the fixing roller 121 is preferably 40% or more and 50% or less given the fixable temperature range with excess and deficiency of heat along with increase and decrease of passing time through the fixing nip section 12*a*.

Experiment B

Setting of Hardness of Elastic Layer

The pressure-contact load by the pressure roller 122 with respect to the fixing roller 121 was set to 650 N, and the fixing roller 121 having the elastic layer 121*b* whose Asker C hardness is different was used, so that relation between the Asker C hardness, the nip width at the fixing nip section 12*a* and the fixable temperature range was evaluated. Note that, it is possible to adjust the Asker C hardness of the elastic layer 121*b* according to a size of an air bubble of silicone sponge rubber constituting the elastic layer 121*b*, or the like.

Additionally, in the experiment B, the pressing rate of the elastic layer 121*b* was 45%, and the repulsive rate described below was 70%. Evaluation results are shown in Table 2.

TABLE 2

| | Asker C hardness (degrees) | | | | | |
|---|---|---|---|---|---|---|
| | 53 | 50 | 45 | 30 | 22 | 20 |
| Nip width (mm) | 11.0 | 12.0 | 14.2 | 15.5 | 16.3 | 16.4 |
| Fixable temperature range (deg) | 25 | 30 | 40 | 40 | 40 | 40 |

As cleared from the results in Table 2, it is found out that with the Asker C hardness of the elastic layer 121*b* of the fixing roller 121 of 20 degrees or more and less than 30 degrees, the fixable temperature range is wide. The reason is that with the Asker C hardness of the elastic layer 121*b* of 20 degrees or more and less than 30 degrees, it is possible to set the nip width as the width in the conveyance direction of the recording paper at the fixing nip section 12*a* to 15.5 mm or more and 16.4 mm or less, thus making it possible to extend passing time through the fixing nip section 12*a* by the recording paper and efficiently heat the toner image on the recording paper in contact with the fixing belt 124.

Experiment C

Setting of Repulsive Rate of Elastic Layer

Figure 2:
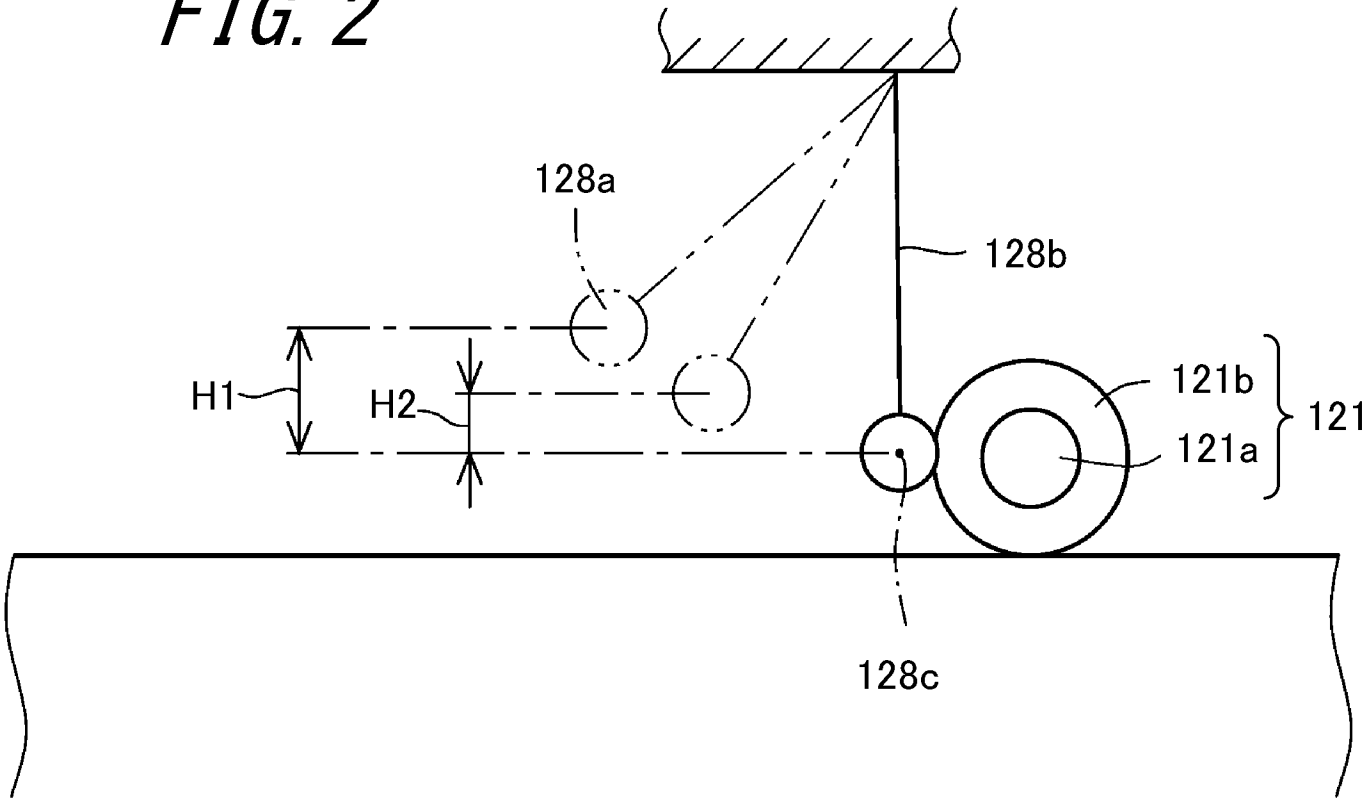
FIG. 2 is a diagram for describing a method for measuring repulsion properties of the fixing roller.

FIG. 2 is a diagram for describing a method for measuring repulsion properties of the fixing roller 121. The repulsive rate of the elastic layer 121*b* of the fixing roller 121 is measured as follows. As shown in FIG. 2, first, the fixing roller 121 is disposed horizontally. A spherical weight 128*a* having an outer diameter of 11 mm and weight of 7 g is suspended by a 50 cm-long thread 128*b*. The spherical weight 128*a* is, in a resting state, disposed so as to contact with the fixing roller 121 so that the center of gravity of the spherical weight 128*a* is positioned on a horizontal plane including a central axis of the fixing roller 121. A position at which the spherical weight is disposed in this way is regarded as a lowest point 128*c*. The height for suspending the spherical weight 128*a* is adjusted so that the spherical weight 128*a* is positioned at the lowest point 128*c*.

Next, the spherical weight 128*a* is pulled up by 10 cm from the lowest point 128*c* to prevent the thread 128*b* from loosening. The height to which the spherical weight 128*a* is pulled up is regarded as an initial height H1. The direction to which the spherical weight 128*a* is pulled up is a direction vertical to the axial direction of the fixing roller 121. When the spherical weight 128*a* is released gently, the spherical weight 128*a* hits the fixing roller 121 to rebound. At the time, difference between the highest position of rebound and the lowest point 128*c* in the vertical direction is regarded as a return height H2. The higher the repulsion properties of the elastic layer 121*b* of the fixing roller 121 is, the higher the H2 becomes. A repulsive rate "R" is calculated based on the following equation (2), where the repulsive rate of the elastic layer 121*b* of the fixing roller 121 is "R".

$$\text{Repulsive rate } R(\%)=(H2/H1)\times 100 \quad (2)$$

Note that, it is possible to adjust the repulsive rate of the elastic layer 121*b* according to the size of an air bubble of the silicone sponge rubber constituting the elastic layer 121*b*, or the like, and theoretical limitation of the repulsive rate is 100%.

Additionally, in the experiment C, the pressing rate on the elastic layer 121*b* was 45%, and the Asker C hardness of the elastic layer 121*b* was 20 degrees.

Table 3 shows evaluation results in which relation between the repulsive rate of the elastic layer 121*b* and the self-peeling temperature range was evaluated.

TABLE 3

| Repulsive rate (%) | 50 | 55 | 65 | 70 |
|---|---|---|---|---|
| Self-peeling temperature range (deg) | 35 | 40 | 50 | 50 |

As cleared from the results in Table 3, it is found out that with the repulsive rate of 65% or more on the elastic layer 121*b* of the fixing roller 121, the self-peeling temperature range is wide. The reason is that with the repulsive rate of 65% or more on the elastic layer 121*b*, it is possible to increase a strain release effect of the elastic layer 121*b*, thus making it possible to improve peeling properties of recording paper passing through the fixing nip section 12*a* with respect to the fixing belt 124. More specifically, the elastic layer 121*b* is compressed by the fixing nip section 12*a* to be strained, and strain thereof is released at an exit of the fixing nip section 12*a* (a downstream side in the conveyance direction of recording paper), thus at the exit of the fixing nip section 12*a*, a gap is generated between the elastic layer 121*b* and the recording paper through the fixing belt 124. As a result, it is possible to improve the peeling properties of the recording paper passing through the fixing nip section 12*a* with respect to the fixing belt 124.

Figure 3:
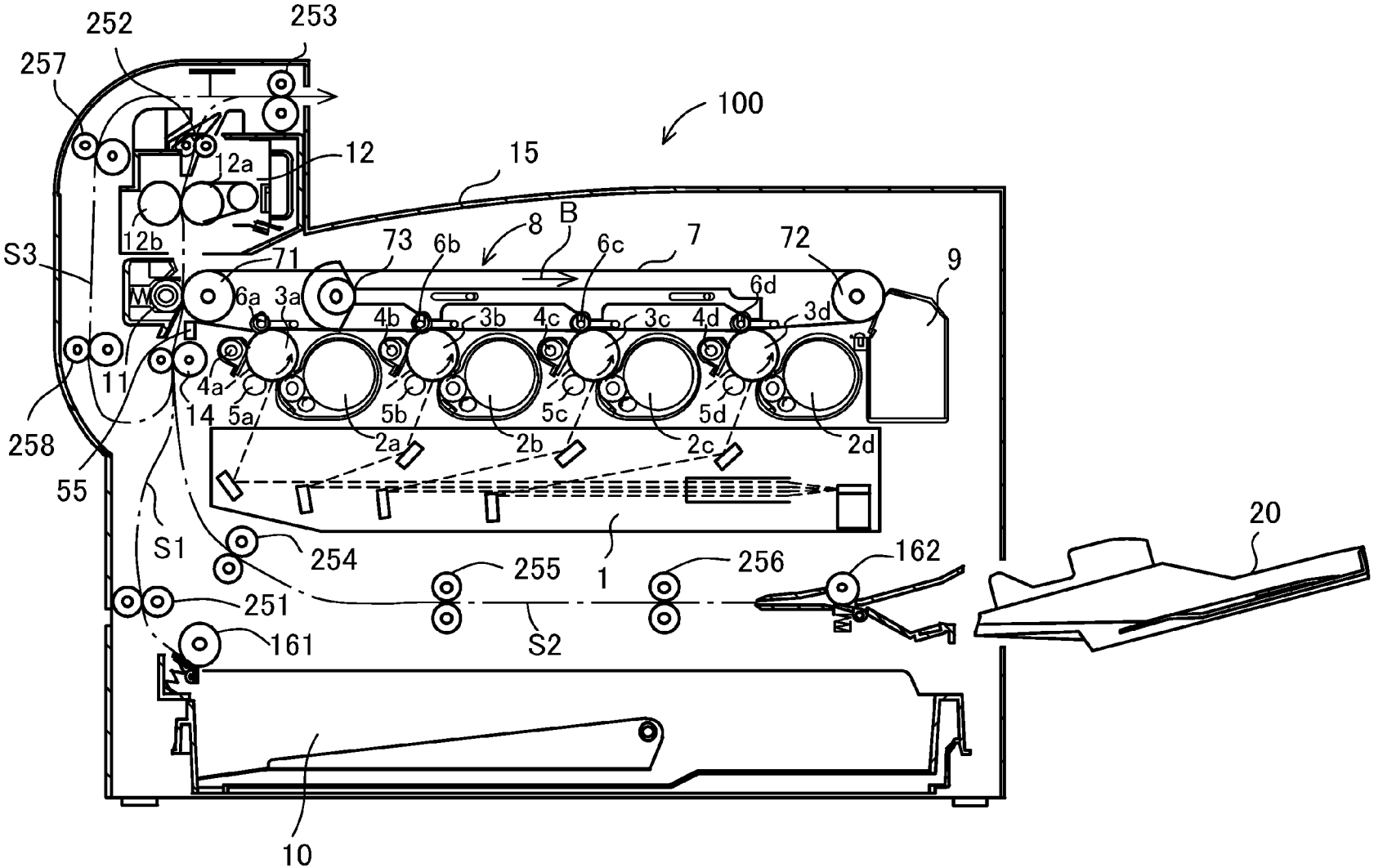
FIG. 3 is a schematic diagram for schematically showing a configuration of an image forming apparatus according to an embodiment.

FIG. 3 is a schematic diagram for schematically showing a configuration of an image forming apparatus 100 according to an embodiment. The image forming apparatus 100 is an apparatus for forming a multicolor image or a monochrome image for the recording paper 127*a* based on image data of a read document or image data transmitted through a network or the like. The image forming apparatus 100 includes an exposure unit 1, photoreceptor drums 3 (3*a* to 3*d*), developing devices 2 (2*a* to 2*d*), charging devices 5 (5*a* to 5*d*), cleaning units 4 (4*a* to 4 *d*), an intermediate transfer belt unit 8, primary transfer rollers 6 (6*a* to 6*d*), a secondary transfer roller 11, a fixing device 12, paper conveyance paths S (S1 to S3), a paper feeding cassette 10, a manual paper feeding tray 20, and a paper discharge tray 15.

The image forming apparatus 100 performs image formation in each of image forming units corresponding to each of four colors of black (K) as well as cyan (C), magenta (M), yellow (Y) which are three primary colors of subtractive mixture colors obtained by color separation of a color image by using image data corresponding to each of the colors. Each of the image forming units is configured similarly, and for example, an image forming unit for black (K) includes a photoreceptor drum 3*a*, a developing device 2*a*, a charging device 5*a*, a primary transfer roller 6*a*, and a cleaning unit 4*a*. An image forming unit for cyan (C) includes a photoreceptor drum 3*b*, a developing device 2*b*, a charging device 5*b*, a primary transfer roller 6*b*, and a cleaning unit 4*b*. An image forming unit for magenta (M) includes a photoreceptor drum 3*c*, a developing device 2*c*, a charging device 5*c*, a primary transfer roller 6*c*, and a cleaning unit 4*c*. An image forming unit for yellow (Y) includes a photoreceptor drum 3*d*, a developing device 2*d*, a charging device 5*d*, a primary transfer roller 6*d*, and a cleaning unit 4*d*. These image forming units are arranged in a line in a moving direction of an intermediate transfer belt 7 of the intermediate transfer belt unit 8.

The charging devices 5 are contact-type roller-shaped chargers for charging the surfaces of the photoreceptor drums 3 uniformly to predetermined potential. Instead of the roller-shaped charging devices 5, contact-type chargers using charging brushes, or noncontact-type chargers using charging wires are also usable.

The exposure unit 1 has a function of exposing the charged photoreceptor drums 3 corresponding to input image data, thereby forming on which surfaces electrostatic latent images corresponding to the image data. In the embodiment, as the exposure unit 1, a laser scanning unit (LSU) including a laser irradiation section and a reflective mirror is used. Note that, as the exposure unit 1, an EL or LED writing head in which light emitting devices are arranged in an array may be used, for example.

The developing devices 2 supply a toner to the surfaces of the photoreceptor drums 3 on which electrostatic latent images are formed, and develop the electrostatic latent images to toner images. The respective developing devices 2*a* to 2*d* contain toners of the respective colors of black (K), cyan (C), magenta (M), and yellow (Y), and visualize the electrostatic latent images of the respective colors formed on the respective photoreceptors drums 3*a* to 3*d* into toner images of the respective colors. The cleaning units 4 remove and collect residual toners on the surfaces of the photoreceptor drums 3 after development and image transfer.

The intermediate transfer belt unit 8 disposed above the photoreceptor drums 3 includes the intermediate transfer belt 7, an intermediate transfer belt driving roller 71, an intermediate transfer belt tension mechanism 73, an intermediate transfer belt driven roller 72, the primary transfer rollers 6 (6*a* to 6*d*), and an intermediate transfer belt cleaning unit 9.

The intermediate transfer belt 7 is wound under tension among the intermediate transfer belt driving roller 71, the intermediate transfer belt tension mechanism 73, the primary transfer rollers 6, and the intermediate transfer belt driven roller 72, and is driven to rotate in a direction of an arrow B of FIG. 3. An outer circumferential surface of the intermediate transfer belt 7 faces the photoreceptor drum 3*d*, the photoreceptor drum 3*c*, the photoreceptor drum 3*b*, and the photoreceptor drum 3*a* in this order. The primary transfer rollers 6*a* to 6*d* are disposed at positions facing the respective photoreceptor drums 3*a* to 3*d* with the intermediate transfer belt 7 interposed therebetween. The respective positions at which the intermediate transfer belt 7 faces the photoreceptor drums 3*a* to 3*d* are primary transfer positions. Additionally, the intermediate transfer belt 7 is formed of a film with a thickness of about 100 μm to 150 μm.

The primary transfer rollers 6*a* to 6*d* are rotatably supported by an intermediate transfer roller attaching sections of the intermediate transfer belt tension mechanism 73 of the intermediate transfer belt unit 8. To the primary transfer rollers 6*a* to 6*d*, a primary transfer bias of a polarity opposite to a charging polarity of a toner is applied under constant voltage control in order to transfer toner images borne on the surfaces of the photoreceptor drums 3*a* to 3*d* onto the intermediate transfer belt 7. Thereby, toner images with the respective colors formed on the photoreceptor drums 3*a* to 3*d* are transferred and overlaid sequentially onto an outer circumferential surface of the intermediate transfer belt 7, so that a full-color toner image is formed on the outer circumferential surface of the intermediate transfer belt 7.

Here, when image data for only a part of the colors of yellow (Y), magenta (M), cyan (C) and black (B) is inputted, electrostatic latent images and toner images are formed at only a part of the photoreceptor drums 3 corresponding to the colors of the inputted image data among the four photoreceptor drums 3*a* to 3*d*. For example, during monochrome image formation, an electrostatic latent image and a toner image are formed only at the photoreceptor drum 3*a* corresponding to black color, and only a black toner image is transferred onto the outer circumferential surface of the intermediate transfer belt 7.

The respective primary transfer rollers 6*a* to 6*d* have a structure comprising a shaft having a diameter of 8 to 10 mm, made of a metal such as stainless steel as a base member, and a conductive elastic material (for example, EPDM or urethane foam) with which a surface of the shaft is coated, and uniformly apply a high voltage to the intermediate transfer belt 7 by the conductive elastic material.

The toner image transferred onto the outer circumferential surface of the intermediate transfer belt 7 at each of the primary transfer positions is conveyed to a secondary transfer position, which is a position facing the secondary transfer roller 11, by the rotation of the intermediate transfer belt 7. The secondary transfer roller 11 is in pressure-contact, at predetermined nip pressure, with the outer circumferential surface of the intermediate transfer belt 7 whose inner circumferential surface is in contact with a circumferential surface of the intermediate transfer belt driving roller 71 during image formation. When the recording paper 127*a* fed from the paper feeding cassette 10 or the manual paper feeding tray 20 passes through between the secondary transfer roller 11 and the intermediate transfer belt 7, high voltage with a polarity opposite to a charging polarity of a toner is applied to the secondary transfer roller 11. Thereby, the toner image 127*b* is transferred from the outer circumferential surface of the intermediate transfer belt 7 onto the surface of the recording paper 127*a*.

One of the secondary transfer roller 11 and the intermediate transfer belt driving roller 71 is a roller made of a hard material (such as metal), and another roller is made of a soft material (such as elastic rubber or a foamable resin) so that the secondary transfer roller 11 obtains the above-described nip pressure constantly.

Additionally, in the vicinity of the secondary transfer position, an optical sensor 55 for detecting the toner image 127*b* borne by the intermediate transfer belt 7 is disposed. The optical sensor 55 outputs detected voltage in an amount based on a detected amount of light.

Note that, a toner remaining on the intermediate transfer belt 7 which has not been transferred onto the recording paper 127*a* among toners adhered to the intermediate transfer belt 7 from the photoreceptor drums 3 is removed and collected by the intermediate transfer belt cleaning unit 9 so as to prevent color mixture at a next step. The intermediate transfer belt cleaning unit 9 is provided with a cleaning blade as a cleaning member in contact with the intermediate transfer belt 7. Additionally, the intermediate transfer belt 7 with which the cleaning blade contacts is supported from the backside thereof by the intermediate transfer belt driven roller 72.

The recording paper 127*a* onto which the toner image 127*b* is transferred is guided to the above-mentioned fixing device 12 according to the technology, passing through the fixing nip section 12*a* to be heated and pressurized. Thereby, the toner image 127*b* is fixed firmly onto the surface of the recording paper 127*a*. The recording paper 127*a* onto which the toner image 127*b* is fixed is discharged onto the paper discharge tray 15 by paper discharge rollers 253.

The image forming apparatus 100 is provided with the paper conveyance path S1 extending in a substantially vertical direction, for feeding the recording paper 127*a* contained in the paper feeding cassette 10, through a position between the secondary transfer roller 11 and the intermediate transfer belt 7 as well as through the fixing device 12, to the paper discharge tray 15. Disposed in the paper conveyance path S1 are a pickup roller 161 for picking up the recording paper 127*a* in the paper feeding cassette 10 sheet by sheet into the paper conveyance path S1, conveying rollers 251 for conveying the dispatched recording paper 127*a* upward, and registration rollers 14 for guiding the fed recording paper 127*a* between the secondary transfer roller 11 and the intermediate transfer belt 7 at predetermined timing, conveying rollers 252 for conveying the recording paper 127*a* after passing through the fixing device 12, and the paper discharge rollers 253 for discharging the recording paper 127*a* to the paper discharge tray 15.

Moreover, inside the image forming apparatus 100, the paper conveyance path S2 on which a pickup roller 162 and conveying rollers 254, 255, 256 are disposed is formed between the manual paper feeding tray 20 and the registration rollers 14. In addition, the paper conveyance path S3 is formed between the paper discharge rollers 253 and an upstream side of the registration rollers 14 in the paper conveyance path S1.

The paper discharge rollers 253 freely rotate in both forward and reverse directions, and are driven in the forward direction and discharge the recording paper 127*a* to the paper discharge tray 15 during single-sided image formation in which an image is formed on one side of the recording paper 127*a*, and during second side image formation of double-sided image formation in which an image is formed on both sides of the recording paper 127*a*. On the other hand, during first side image formation of double-sided image formation, the paper discharge rollers 253 are driven in the forward direction until a rear edge of the paper passes through the fixing device 12, and are then driven in a reverse direction to guide the recording paper 127*a* into the paper conveyance path S3 in which the conveying rollers 257 and 258 are disposed in a state where the rear edge part of the recording paper 127*a* is held. Thereby, the recording paper 127*a* on which an image has been formed only on one side during double-sided image formation is guided to the paper conveyance path S1 in a state where the recording paper 127*a* is turned over and upside down.

The registration rollers 14 bring the recording paper sheet 127*a* that has been fed from the paper feeding cassette 10 or the manual paper feeding tray 20, or has been conveyed through the paper conveyance path S3, between the secondary transfer roller 11 and the intermediate transfer belt 7 at a timing synchronized with the rotation of the intermediate transfer belt 7. Thus, the rotation of the registration rollers 14 is stopped when the operation of the photoreceptor drums 3 or the intermediate transfer belt 7 is started, and the movement of the recording paper sheet 127*a* that has been fed or conveyed prior to the rotation of the intermediate transfer belt 7 is stopped in the paper conveyance path S1 in a state where a leading edge thereof abuts against the registration rollers 14. Then, the rotation of the registration rollers 14 is started at a timing when the leading edge of the recording paper sheet 127*a* faces a leading edge of a toner image 127*b* formed on the intermediate transfer belt 7 at a position where the secondary transfer roller 11 is brought into pressure-contact with the intermediate transfer belt 7.

The image forming apparatus 100 of the embodiment includes the fixing device 12 of the embodiment having excellent fixation properties when the toner image 127*b* is fixed onto the recording paper 127*a*. Therefore, the image forming apparatus 100 is able to form an image having favorable image quality.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A fixing device comprising:

an endless fixing belt for contacting with a toner image on a member to be subjected to fixation and fixing the toner image onto the member to be subjected to fixation;

a heating roller for contacting with an inner circumferential surface of the endless fixing belt and heating the endless fixing belt;

a fixing roller including a base member and an elastic layer disposed on a surface of the base member, the endless fixing belt being wound under tension between the fixing roller and the heating roller, the fixing roller contacting with the toner image on the member to be subjected to fixation through the endless fixing belt; and a pressure roller for coming into pressure-contact with the fixing roller through the endless fixing belt, the elastic layer having a pressing rate of 40% or more and 50% or less, the pressing rate being a ratio of a deformation amount when being brought into pressure-contact with the pressure roller through the endless fixing belt with respect to a thickness size when not being brought into pressure-contact, and having an Asker C hardness of 20 degrees or more and less than 30 degrees.

2. The fixing device of claim 1, wherein the elastic layer has a repulsive rate of 65% or more.

3. The fixing device of claim 2, wherein the elastic layer has a pressing rate of 45% and an Asker C hardness of 20 degrees.

4. An image forming apparatus comprising the fixing device of claim 1.

* * * * *